United States Patent [19]

Curry et al.

[11] Patent Number: 4,560,492

[45] Date of Patent: Dec. 24, 1985

[54] LAUNDRY DETERGENT COMPOSITION WITH ENHANCED STAIN REMOVAL

[75] Inventors: John D. Curry, Oxford; James B. Edwards, Cincinnati, both of Ohio

[73] Assignee: The Procter & Gamble Company, Cincinnati, Ohio

[21] Appl. No.: 667,783

[22] Filed: Nov. 2, 1984

[51] Int. Cl.[4] ..... C11D 9/30

[52] U.S. Cl. ..... 252/110; 252/117; 252/173; 252/174.22; 252/527; 252/546; 252/DIG. 14

[58] Field of Search ..... 252/DIG. 11, 550, 551, 252/558, 174.21, DIG. 14, 110, 117, 527, 174.22, 173, 546

[56] References Cited

U.S. PATENT DOCUMENTS

| | | | |
|---|---|---|---|
| 2,921,908 | 1/1960 | McCune | 252/110 |
| 3,151,084 | 9/1964 | Schiltz et al. | 252/137 |
| 3,265,625 | 8/1966 | Grob | 252/152 |
| 3,368,978 | 2/1968 | Irani | 252/137 |
| 3,591,405 | 7/1971 | McCarty | 117/33.5 |
| 3,798,179 | 3/1974 | Hellyer | 252/535 |
| 3,899,447 | 8/1975 | McDonald | 252/539 |
| 3,920,564 | 11/1975 | Grecsek | 252/8.75 |
| 3,953,380 | 4/1976 | Sundby | 252/543 |
| 3,970,596 | 7/1976 | Klisch et al. | 252/546 |
| 4,083,793 | 4/1978 | Jakobi et al. | 252/99 |
| 4,110,262 | 8/1978 | Arnau et al. | 252/545 |
| 4,111,855 | 9/1978 | Barrat et al. | 252/545 |
| 4,240,918 | 12/1980 | Lagasse et al. | 252/95 |
| 4,265,777 | 5/1981 | Boyer et al. | 252/113 |
| 4,274,975 | 6/1981 | Corkill et al. | 252/140 |
| 4,286,956 | 9/1981 | Bechstedt | 252/121 |
| 4,330,423 | 5/1982 | Smolka et al. | 252/99 |
| 4,397,776 | 8/1983 | Ward | 252/527 |
| 4,462,922 | 7/1984 | Boskamp | 252/174.12 |

FOREIGN PATENT DOCUMENTS

| | | |
|---|---|---|
| 818151 | 8/1953 | United Kingdom . |
| 1513550 | 6/1978 | United Kingdom . |

*Primary Examiner*—Paul Lieberman
*Assistant Examiner*—Willie J. Thompson
*Attorney, Agent, or Firm*—Edmund F. Gebhardt; Steven J. Goldstein; Jack D. Schaeffer

[57] ABSTRACT

Laundry detergent compositions essentially free of inorganic phosphate detergency builders and containing from about 3% to about 60% by weight of water-insoluble sodium aluminosilicate or organic detergency builder components and from about 0.5% to about 10% by weight hydroxyethylethylenediaminetriacetic acid or salts thereof have enhanced organic stain removal characteristics.

10 Claims, No Drawings

LAUNDRY DETERGENT COMPOSITION WITH ENHANCED STAIN REMOVAL

TECHNICAL FIELD

The present invention relates to laundry detergent compositions substantially free of inorganic phosphate salts and containing a hydroxyethylethylenediaminetriacetate compound (HEDTA) which assists in the removal of food, beverage and certain other organic stains during the laundry process.

Government requirements directed to the restriction of or prohibition of phosphorus content of detergent compositions has necessitated the use of detergency builders less effective than the polyphosphates, e.g. pyrophosphates, tripolyphosphates and metaphosphates. Such requirements have complicated the formulation of effective laundry detergent compositions and the users of such compositions have paid a price in terms of cleaning efficiency in general and stain removal in particular. The present invention provides a surprising benefit in stain removal effectiveness for detergent compositions that contain no inorganic phosphates or only low levels, particularly those compositions that can be characterized as builder deficient.

BACKGROUND ART

HEDTA and various other nitrilopolycarboxylates such as nitrilotriacetates (NTA) and ethylenediaminetetracetates (EDTA) have been used as detergent additives for various purposes. For example, British Patent Specification 818,151 published Aug. 12, 1959, a patent of addition to British patent specification No. 716,574, discloses mixtures of alkali metal phosphates with salts of polycarboxylated amines including the sodium salt of hydroxyethyl ethylenediaminetriacetate.

U.S. Pat. No. 2,921,809 issued Jan. 19, 1960 to McCune discloses a detergent composition containing sodium alkylbenzene sulfonate, the sodium salt of hydroxyethylethylenediaminetriacetate (HEDTA) and a phosphated alkyl polyethylene glycol corrosion inhibitor.

U.S. Pat. No. 3,591,405 issued July 6, 1971, to McCarty discloses rinse-added fabric softener compositions containing 4–50% of a quaternary ammonium compound, 25–94% of a polyphosphonate, an optical brightener and 0–31% of a polyacetate sequestering agent. Suitable polyacetates are identitied as including EDTA, NTA, and HEDTA.

U.S. Pat. No. 3,151,084 issued Sept. 29, 1964, to Schiltz et al. discloses alkylbenzenesulfonate-containing detergent compositions in which solubility is said to be improved by the addition of 0.25–4% of a mixture of EDTA and another amino solubilizing agent selected from salts of N,N-di(2-hydroxyethyl)glycine, iminodiacetic acid, NTA and HEDTA.

U.S. Pat. No. 3,970,596 issued July 20, 1976, to Klish et al., discloses 0.1–0.2% HEDTA in liquid dishwashing compositions containing no other detergent builder components.

U.S. Pat. No. 3,920,564 issued Nov. 18, 1975, to Greciek discloses softener/detergent compositions containing surfactants, quaternary ammonium or diamine fabric softeners and a builder salt selected from aminocarboxylates, citrate and mixtures. Example IV replaces 35% NTA in prior examples with 35% HEDTA.

U.S. Pat. No. 3,899,477 issued Aug. 12, 1975, to McDonald, discloses aqueous detergent compositions containing anionic surfactants and a colloidal silica sol formed in situ. Example IV compositions contain HEDTA.

British Pat. No. 1,513,550 issued to Hampson published June 7, 1978, discloses dishwashing detergent compositions containing surfactants, 0.5–30% of a magnesium salt and 3–60% of an organic sequestering agent having a pK value for calcium of at least 3 and a difference between the pK value for calcium and magnesium of at least 0.5. A number of hydroxyalkyl-substituted chelating agents are disclosed.

U.S. Pat. No. 4,397,776 issued Aug. 3, 1983, to Ward, discloses liquid detergent compositions containing 0.005%–40% alpha amine oxide $C_{12-18}$ carboxylates and 0.001%–35% chelating agents. Example 11-B discloses a composition containing HEDTA.

None of these references disclose the compositions of the present invention or recognize the unique fabric stain removal properties of HEDTA or related compounds in the context of laundry detergent compounds containing no or low levels of inorganic phosphate detergency builders.

DISCLOSURE OF THE INVENTION

The compositions of this invention are laundry detergents substantially free of inorganic phosphate salts comprising:

(a) from about 10% to about 65% by weight of a detergent surfactant selected from the group consisting of non-soap anionic surfactants, nonionic surfactants, zwitterionic surfactants, ampholytic surfactants, cationic surfactants and mixtures thereof;

(b) from about 3% to about 60% by weight of a detergency builder selected from the group consisting of water-insoluble sodium aluminosilicates and organic detergency builders selected from the group consisting of $C_{10-18}$ monocarboxylic acids, polycarboxylic acids not containing both nitrogen and hydroxyalkyl radicals, polymeric carboxylates, polyphosphonic acids, salts thereof, and mixtures thereof;

(c) from about 0.5% to about 10% hydroxyethylethylenediaminetriacetic acid or alkali metal, alkaline earth metal, ammonium or substituted ammonium salts thereof;

(d) from 0% to about 75%, by weight of a water-soluble inorganic detergency builder selected from the group consisting of alkali metal silicates, alkali metal carbonates and mixtures thereof.

It is a purpose of the invention to provide laundry detergent compositions substantially free of inorganic phosphates that possess improved stain removal characteristics relative to prior art compositions free of inorganic phosphates.

DETAILED DESCRIPTION OF THE INVENTION

Detergent Surfactants

The detergent surfactant can be selected from non-soap anionic, nonionic, zwitterionic, amphoteric and cationic surfactants and mixtures thereof. The surfactants comprise from about 10% to about 65%, preferably from about 15% to about 30%, of the composition by weight.

a. Non-Soap Anionic Surfactants

Non-soap anionic surfactants can be represented by the general formula R $SO_3M$ wherein R represents a hydrocarbon group selected from the group consisting of straight or branched alkyl radicals containing from about 8 to about 24 carbon atoms and alkyl phenyl radicals containing from about 9 to about 15 carbon atoms in the alkyl group. M is a salt-forming cation which typically is selected from the group consisting of sodium, potassium, ammonium, monoalkanolammonium, dialkanolammonium, trialkanolammonium, and magnesium cations and mixtures thereof.

Preferred non-soap anionic surfactants include the water-soluble salts of alkylbenzene sulfonic acid containing from about 9 to about 15 carbon atoms in the alkyl group and water-soluble alkyl sulfates containing from about 10 to about 18 carbon atoms.

Another preferred non-soap anionic surfactant is a water-soluble salt of an alkyl polyethoxylate ether sulfate wherein the alkyl group contains from about 8 to about 24, preferably from about 10 to about 18 carbon atoms and there are from about 1 to about 20, preferably from about 1 to about 12 ethoxy groups. Other suitble anionic surfactants are disclosed in U.S. Pat. No. 4,170,565, Flesher et al, issued Oct. 9, 1979, incorporated herein by reference.

b. Nonionic Surfactants

One useful type of nonionic surfactant is produced by condensing ethylene oxide with a hydrocarbon having a reactive hydrogen atom, e.g., a hydroxyl, carboxyl, amino, or amido group, in the presence of an acidic or basic catalyst. Such nonionic surfactants have the general formula $RA(CH_2CH_2O)_nH$ wherein R represents the hydrophobic group, A represents the group carrying the reactive hydrogen atom and n represents the average number of ethylene oxide groups. R typically contains from about 8 to 22 carbon atoms, but can also be formed by the condensation of propylene oxide with a lower molecular weight compound. n can vary from about 6 to about 24, preferably from about 6 to about 10, depending on the desired physical and detergency properties. The hydrophobic moiety of the nonionic compound is preferably a primary or secondary, straight or slightly branched, aliphatic alcohol having from about 8 to about 24, preferably from about 12 to about 20 carbon atoms.

Semi-polar nonionc surfactants include water-soluble amine oxides containing one alkyl or hydroxy alkyl moiety of from about 8 to about 28 carbon atoms and two moieties selected from the group consisting of alkyl groups and hydroxy alkyl groups, containing from 1 to about 3 carbon atoms which can optionally be joined into ring structures; water-soluble phosphine oxides containing one alkyl or hydroxy alkyl moiety of from about 8 to about 28 carbon atoms and two moieties selected from the group consisting of alkyl groups and hydroxy alkyl groups containing from about 1 to about 3 carbon atoms; and water-soluble sulfoxides containing an alkyl or hydroxy alkyl moiety of from about 8 to about 28 carbon atoms and a moiety selected from the group consisting of alkyl and hydroxyalkyl moieties containing from 1 to 3 carbon atoms.

Another class of useful nonionic surfactants are alkylpolysaccharides having a hydrophobic group containing from about 8 to about 20 carbon atoms and a polysaccharide hydrophilic group containing from about 1.5 to about 10 saccharide units.

A more complete disclosure of suitable nonionic surfactants useful in the present invention can be found in U.S. Pat. No. 4,111,855 issued Sept. 5, 1978, to Barrat et al, incorporated herein by reference.

c. Zwitterionic Surfactants

Zwitterionic surfactants include derivatives of aliphatic quaternary ammonium, phosphonium, and sulfonium compounds in which the aliphatic moiety can be straight or branched chain and wherein one of the aliphatic substituents contains from about 8 to 24 carbon atoms and one contains an anionic water-solubilizing group. Particularly preferred zwitterionic materials are the ethoxylated ammonium sulfonates and sulfates disclosed in U.S. Pat. No. 3,925,262, Laughlin et al, issued Dec. 9, 1975 and U.S. Pat. No. 3,929,678, Laughlin et al, issued Dec. 30, 1975, said patents being incorporated herein by reference.

d. Ampholytic Surfactants

Ampholytic surfactants include derivatives of aliphatic heterocyclic secondary and tertiary amines in which the aliphatic group can be straight chain or branched and wherein one of the aliphatic substituents contains from about 8 to about 24 carbon atoms and at least one aliphatic substituent contains an anionic water-solubilizing group.

e. Cationic Surfactants

Suitable cationic surfactants have the general formula $$R_m^2R_x^3Y_lZ$$

wherein each $R^2$ is an organic group containing a straight or branched alkyl or alkenyl group optionally substituted with up to three phenyl or hydroxy groups and optionally interrupted by up to four structures selected from the group consisting of

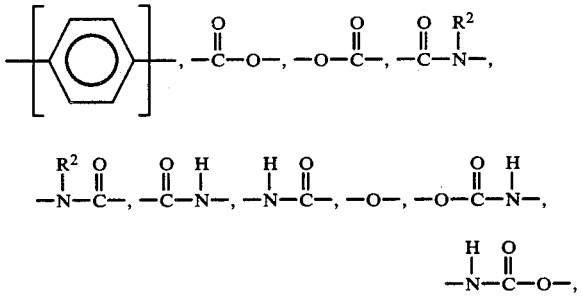

mixtures thereof, each $R^2$ containing from about 8 to 22 carbon atoms, and which may additionally contain up to about 12 ethylene oxide groups, m is a number from 1 to 3, each $R^3$ is an alkyl or hydroxyalkyl group containing from 1 to 4 carbon atoms or a benzyl group with no more than one $R^3$ in a molecule being benzyl, x is a number from 0 to 1, the remainder of any carbon atoms position being filled by hydrogens, Y is selected from the group consisting of:

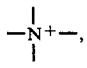

(1)

-continued (2)

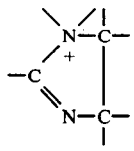

(3)

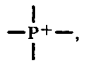

(4)

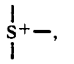

(5)

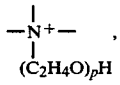

wherein p is from 1 to 12, (6)

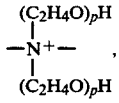

wherein p is from 1 to 12, (7)

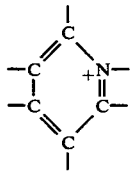

(8)

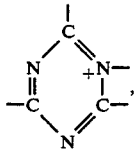

and (9) mixtures thereof and Z is an anion such as halide, methyl sulfate or hydroxide.

One $R_3$ can also be a proton. The resultant tertiary amines can have characteristics similar to cationic surfactants at washing solution pH values less than about 8.5.

A more complete disclosure of useful cationic surfactants can be found in U.S. Pat. No. 4,228,044, Cushman M. Cambre, issued Oct. 14, 1980, incorporated herein by reference.

When cationic surfactants are used in combination with anionic surfactants, and certain other materials with complex soluble anions, compatibility must be considered. A type of cationic surfactant generally compatible with anionic surfactants and carboxylates is a $C_{8-18}$ alkyl tri $C_{1-3}$ alkyl ammonium chloride or methyl sulfate.

For a more complete disclosure of surfactants which are suitable for incorporation in detergent compositions, one can consult U.S. Pat. Nos. 4,056,481, Tate (Nov. 1, 1977); 4,049,586, Collier (Sept. 20, 1977); 4,040,988, Vincent et al (Aug. 9, 1977); 4,035,257, Cherney (July 12, 1977); 4,033,718, Holcolm et al (July 5, 1977); 4,019,999, Ohren et al (Apr. 26, 1977); 4,019,998, Vincent et al (Apr. 26, 1977); and 3,985,669, Krummel et al (Oct. 12, 1976); all of said patents being incorporated herein by reference.

Aluminosilicate and Organic Detergency Builders

The compositions of the invention contain from about 3% to about 60%, preferably from about 8% to about 30%, and most preferably from about 12% to about 25%, of a detergency builder selected from the group consisting of water-insoluble sodium aluminosilicate and an organic detergency builder or mixture thereof. Detergency builders improve cleaning, particularly when the washing solution will contain metal ions other than alkali metal, ammonium or substituted ammonium ions. Sodium aluminosilicate materials described herein remove multivalent ions, especially calcium, from washing solutions by ion exchange. The organic detergency builders of the present invention remove multivalent ions from interference in the washing process by precipitation or sequestration. Sequestration involves the formation of a coordination complex of the sequestering agent and metallic ions in solution to reduce the interactions of calcium with other materials in the wash solution. As used herein, the term sequestering agent includes multidentate ligands which can act as chelating agents.

Crystalline aluminosilicate ion exchange materials useful in the practice of this invention have the formula $Na_z[(AlO_2)_z.(SiO_2)y.xH_2O$ wherein z and y are at least about 6, the molar ratio of z to y is from about 1.0 to about 0.5 and x is from about 10 to about 264. In a preferred embodiment the aluminosilicate ion exchange material has the formula $Na_{12}[(AlO_2)_{12}(SiO_2)_{12}],xH_2O$ wherein x is from about 20 to about 30, especially about 27.

Amorphous hydrated aluminosilicate material useful herein has the empirical formula: $Na_z(zAlO_2.ySiO_2)$, z is from about 0.5 to about 2, y is 1 and said material has a magnesium ion exchange capacity of at least about 50 milligram equivalents of $CaCO_3$ hardness per gram of anhydrous aluminosilicate.

The aluminosilicate ion exchange builder materials herein are in hydrated form and contain from about 10% to about 28% of water by weight if crystalline and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter of a given ion exchange material as determined by convention analytical techniques such as, for example, microscopic determination utilizing a scanning electron microscope. The crystalline aluminosilicate ion exchange materials herein are usually further characterized by their calcium ion exchange capacity, which is at least about 200 mg. equivalent of $CaCO_3$ water hardness/gm. of aluminosilicate, calculated on an anhydrous basis, and which generally is in the range of from about 300 mg.eq./g. to about 352 mg. eq./g. The aluminosilicate ion exchange materials herein are still further characterized by their calcium ion exchange rate which is at least about 2 grains $Ca.^{++}$/gallon/minute/gram of aluminosilicate (anhydrous basis), and generally lies within the range of from about 2 grains/gallons/minute/gram to about 6 grains/-gallons/minute/gram, based on calcium ion hardness. Optimum aluminosilicate for builder purposes exhibit a calcium ion exchange rate of at least about 4 grains/gallon/minute/gram.

The amorphous aluminosilicate ion exchange materials usually have a $Mg^{++}$ exchange capacity of at least about 50 mg. eq. $CaCO_3$/g (12 mg. $Mg^{++}$/g.) and a $Mg^{++}$ exchange rate of at least about 1 gr./gal.-/min./g./gal. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally-occurring aluminosilicates or synthetically derived. Preferred synthetic crystalline aluminosilicate ion exchange materials useful herein are available under the designation Zeolite A, Zeolite B, and Zeolite X.

The organic detergency builders used in the compositions of this invention include $C_{10-18}$ alkyl monocarboxylates, polycarboxylates, and polyphosphonates in soluble salt or acid form.

$C_{10-18}$ alkyl monocarboxylates include fatty acids and salts thereof (soaps) derived from animal and vegetable fats and oils such as tallow, coconut oil and palm oil. Monocarboxylate compounds with other hydrophilic radicals are considered surfactants (e.g. salts of alpha sulfonated fatty acids).

Suitable polycarboxylates include the acid form and alkali metal, ammonium and substituted ammonium salts of citric, ascorbic, phytic, mellitic, benzene pentacarboxylic, oxydiacetic, carboxymethyloxysuccinic, carboxymethyloxymalonic, cis-cyclohexanexacarboxylic, cis-cyclopentanetetracarboxylic and oxydisuccinic acids. Also suitable are the polymers and copolymers described in U.S. Pat. No. 3,308,067, Diehl, issued Mar. 7, 1967, incorporated herein by reference.

With due regard to their stability in aqueous media, the polyacetal carboxylates disclosed in U.S. Pat. No. 4,144,226 issued Mar. 13, 1979, to Crutchfield et al and U.S. Pat. No. 4,146,495 issued Mar. 27, 1979 to Crutchfield et al can be incorporated in the compositions of the invention.

Additional suitable polycarboxylates are those containing nitrogen, such as ethylenediaminetetraacetic acid, diethylenetriaminepentaacetic acid and nitrilotriacetic acid and alkali metal, ammonium and substituted ammonium salts thereof. For purposes of defining the invention, the organic detergency builder does not comprise polycarboxylic acids or salts thereof that contain both nitrogen and hydroxylalkyl groups.

Polyphosphonates comprise a large range of organic compounds having two or more

—C—$PO_3M_2$ groups, wherein M is a hydrogen or a salt-forming radical. Suitable phosphonates include ethane-1-hydroxy-1,1-diphosphonates, ethanehydroxy-1,1,2-triphosphonates and their oligomeric ester chain condensates. Suitable polyphosphonates for use in the compositions of the invention also include nitrogen-containing polyphosphonates such as ethylenediaminetetramethylene phosphonic acid and diethylenetriaminepentamethylene phosphonic acid and alkali metal, ammonium and substituted ammonium salts thereof. While suitable in compositions of the invention, the use of phosphonates can be subject to restriction because of phosphorus content.

Preferred detergent compositions of the invention contain at least about 3% of an organic detergency builder as described herein. Granular compositions preferably contain at least about 3% of a polycarboxylate organic detergency builder.

Nitrogen-Containing Hydroxyalkyl-Substituted Carboxylates

The compositions of the invention contain as an essential component from about 0.5% to about 10%, preferably from about 2.5% to about 8%, of a nitrogen-containing hydroxyalkyl-substituted carboxylate in acid or soluble salt form, in particular hydroxyethylethylenediaminetriacetic acid or the alkali metal, alkaline earth metal, ammonium, or substituted ammonium salts thereof or mixtures thereof.

Without being bound by theory, it is believed that detergent compositions comprising hydroxyethylethylenediaminetriacetic acid or its salts (HEDTA) and the other essential components of the invention are able to chelate metals such as iron, manganese and copper which are initially a constituent of certain organic stains or act to stabilize such stains when present in the washing solution.

HEDTA appears to have a particular affinity for the chelation of iron, manganese, and other multi-valent metal ions associated with stains in the presence of free alkaline earth metal ions, typically identified as "water hardness", and thereby makes the removal of such stains easier, particularly in detergent compositions containing no phosphate detergency builders.

Water-Soluble Inorganic Detergency Builder

The water-soluble inorganic detergency builders useful in the compositions of the invention at total combined levels of from 0% to about 75% by weight, are alkali metal silicates and alkali metal carbonates. The use of these materials is consistent with the requirement that the compositions of the invention be substantially free of inorganic phosphate salts to meet restrictions or prohibition of phosphorus in detergent compositions by governmental action.

Granular laundry detergent compositions generally contain at least about 40% of inorganic salts and it is desirable that a major portion of such salts have at least some contribution to the detergent effect. Inorganic detergency builders are less useful in the liquid compositions of the invention and can be omitted to provide optimum physical properties and optimum levels of the essential components.

Alkali Metal Silicate

Suitable alkali metal silicates have a mole ratio of $SiO_2$:alkali metal oxide in the range of from about 1:1 to about 4:1. The alkali metal silicate suitable herein include commercial preparations of the combination of silicon dioxide and alkali metal oxide or carbonate fused together in varying proportions according to, for example, the following reaction:

$$mSiO_2 + Na_2CO_3 \xrightarrow{2600^\circ F.} mSiO_2{:}Na_2O + CO_2$$

The value of m, designating the molar ratio of $SiO_2$:-$Na_2O$, ranges from about 0.5 to about 4 depending on the proposed use of the sodium silicate. The term "alkali metal silicate" as used herein refers to silicate solids with any ratio of $SiO_2$ to alkali metal oxide. Silicate solids normally possess a high alkalinity content; in addition water of hydration is frequently present as, for example, in metasilicates which can exist having 5, 6, or 9 molecules of water. Sodium silicate solids with a $SiO_2$:$Na_2O$ mole ratio of from about 1.5 to about 3.5, are preferred in granular laundry detergent compositions.

Silicate solids are frequently added to granular detergent compositions as corrosion inhibitors to provide protection to the metal parts of the washing machine in which the detergent composition is utilized. Silicates have also been used to provide a degree of crispness and pourability to detergent granules which is very desirable to avoid lumping and caking.

Alkali Metal Carbonates

Alkali metal carbonates are useful in the compositions of the invention as a source of washing solution alkalinity and because of the ability of the carbonate ion to remove calcium and magnesium ions from washing solutions by precipitation.

Preferred granular compositions contain from about 10% to about 40% sodium carbonate, from about 10% to about 30% sodium aluminosilicate and from about 0.5% to about 4% sodium silicate solids.

Other Optional Components

The liquid compositions of this invention can contain water and other solvents. Low molecular weight primary or secondary alcohol exemplified by methanol, ethanol, propanol, and isopropanol are suitable. Monohydric alcohols are preferred for solubilizing the surfactant but polyols containing from 2 to about 6 carbon atoms and from 2 to about 6 hydroxy groups can be used and can provide improved enzyme stability. Examples of polyols include propylene glycol, ethylene glycol, glycerine and 1,2-propanediol. Ethanol is a particularly preferred alcohol.

A short chain carboxylic acid salt can be used to stabilize enzymes, particularly proteolytic enzymes, as disclosed in U.S. Pat. No. 4,318,818, issued March 9, 1982, to Letton et al incorporated herein by reference.

The compositions of the invention can contain such materials as proteolytic and amylolytic enzymes, fabric whiteners and brighteners, sudsing control agents, hydrotropes such as sodium toluene or xylene sulfonate, perfumes, colorants, opacifiers, anti-redeposition agents and alkalinity control or buffering agents such as monoethanolamine and triethanolamine. The use of these materials is known in the detergent art.

Preferred liquid compositions contain from about 8% to about 18% of a $C_{12-18}$ monocarboxylic (fatty) acid and from 0.2% to about 10% of a polycarboxylic acid, preferably citric acid, and provide a solution pH of from about 6 to about 8.5 at 1% concentration in water.

The following examples illustrate the invention and facilitate its understanding.

All parts, percentages and ratios herein are by weight unless otherwise specified.

EXAMPLE I

The following composition was prepared by mixing the ingredients listed.

| | |
|---|---|
| $C_{13}$ linear alkyl benzene sulfonic acid | 10.5% |
| Triethanolamine cocoalkyl sulfate | 4.0 |
| $C_{14-15}$ alcohol ethoxylate-7 | 12.0 |
| Lauric acid | 7.5 |
| Myristic acid | 2.5 |
| Oleic acid | 5.0 |
| Citric acid | 0.2 |
| Diethylenetriaminepentamethylene phosphonic acid | 0.3 |
| Hydroxyethylethylenediaminetriacetic acid (HEDTA) | (a) |
| Triethanolamine | 4.5 |
| Ethanol | 8.6 |
| 1,2-Propanediol | 3.0 |
| Sodium formate | 1.0 |
| Water | 35.5 |
| Perfume, fabric whiteners, enzymes, buffers, and miscellaneous | remainder |

(a) as indicated below replacing water

The compositions of Example I with the level of HEDTA as indicated under "Treatments" were prepared for use in washing solutions. Artificially soiled 5"×5" fabrics that represent a range of typical consumer stains as listed below were placed in each washer along with sufficient naturally soiled laundry to provide a typical fabric to washing solution ratio.

Four replicates of each wash treatment were conducted. A balanced complete block paired comparison test design provided for the fabrics representing each stain type for a given treatment to be viewed relative to the other treatments. Each grader provided numerical cleaning difference grades on a nine point scale (−4 through +4) for each comparison.

Treatment means were calculated and are listed in the table below after normalization of the means based on a zero value for Treatment 1.

Evaluation A-Stain Removal

Conditions:
Temperature: 15° C. incoming, 60° C. final
Hardness (gr/gal): 19 gr/gal well water (as $CaCO_3$)
pH: 7.6
Fill level: 14.1 liters (approx.)
Treatments:
1=Comparison of Example I-no HEDTA
2=Composition of Example I plus 2.5% HEDTA
3=Composition of Example I plus 5.0% HEDTA
Comments:
Full scale stain test with soiled laundry included:
Miele washer model 412S, color wash cycle at 60° C.
Pre-wash cycle was omitted
Total fabric load was 3 kg.
4 treatment replicates, 2 sets
Detergent usage: 170 g.

| | Panel Score Unit Difference | | | |
|---|---|---|---|---|
| Soils: | 1 | 2 | 3 | Least Significant Difference (95% confidence level) |
| Grasss | 0.0 | −0.1 | 0.2 | 1.9 |
| Spaghetti sauce | 0.0 | 1.1* | 1.4* | 0.5 |
| Blood | 0.0 | 1.6* | 3.3* | 0.8 |
| Blueberry | 0.0 | 1.7* | 2.2* | 1.5 |
| Tea | 0.0 | 2.2* | 2.1* | 2.1 |

-continued

| Soils: | Panel Score Unit Difference 1 | 2 | 3 | Least Significant Difference (95% confidence level) |
|---|---|---|---|---|
| Dirty Oil | 0.0 | 0.3 | 0.9* | 0.4 |
| Barbecue sauce | 0.0 | 0.5 | 1.0* | 1.0 |

*indicates value is significantly different than treatment 1, a plus value indicating an improvement.

Evaluation B—Stain Removal

The procedure of Evaluation A was repeated with the addition of a treatment in which the composition of Example I contained 1% HEDTA.

Treatments:

1=Composition of Example I—no HEDTA
2=Composition of Example I+1% HEDTA
3=Composition of Example I+2.5% HEDTA
4=Composition of Example I+5% HEDTA

| Soils: (PSU) | Panel Score Unit Difference 1 | 2 | 3 | 4 | Least Significant Difference (95% confidence level) |
|---|---|---|---|---|---|
| Grass | 0.0 | 1.1 | 0.7 | 1.1 | 1.4 |
| Spaghetti sauce | 0.0 | 0.4 | 1.7* | 2.0* | 1.7 |
| Blood | 0.0 | 0.2 | 1.9* | 2.1* | 1.9 |
| Blueberry | 0.0 | 0.5 | 1.6 | 0.2 | 2.2 |
| Tea | 0.0 | 0.2 | 2.1* | 2.5* | 2.0 |
| Dirty Oil | 0.0 | 0.7 | 0.5 | 0.2 | 1.0 |
| Barbecue Sauce | 0.0 | 0.1 | 0.7 | 0.9 | 2.8 |

*indicates value is significantly different than treatment 1, a plus value indicating an improvement.

EXAMPLE II

Liquid detergent compositions are prepared by mixing the components listed hereinafter in the stated proportions.

| | A | B | C |
|---|---|---|---|
| Surfactants | | | |
| $C_{13}$ linear alkyl benzene sulfonic acid | 9.25% | 5.8% | 12.1% |
| Coco alkyl sulfate-acid form | — | 8.8 | — |
| $C_{12-14}$ alkyl ether (ethoxy 1.0) sulfate-acid form | 8.75 | — | 3.9 |
| $C_{12}$ alkyltrimethylammonium chloride | 1.2 | 1.2 | 1.4 |
| $C_{12-13}$ alcohol ethoxy 6.5 condensate | 6.5 | 10.0 | 7.8 |
| Organic Detergency Builders | | | |
| Lauric acid | 10.1 | 7.5 | 9.1 |
| Myristic acid | 4.1 | 2.5 | 3.0 |
| Oleic acid | — | 5.0 | 2.4 |
| Citric Acid | 4.0 | 6.9 | 5.3 |
| Sodium Diethylenetriaminepentaacetate | 0.6 | 0.6 | — |
| Nitrogen-Containing Hydroxyalkyl-Substituted Carboxylate | | | |
| Hydroxyethylethylenediaminetriacetic acid | 2.5 | 2.5 | 2.5 |
| Solvents | | | |
| Water | 28.0 | 17.0 | 28.0 |
| Ethanol | 7.0 | 1.0 | 4.8 |
| 1,2-Propanediol | 5.0 | 5.0 | 7.2 |
| Other Components | | | |
| Monoethanolamine | 2.0 | 12.0 | 1.9 |
| Triethanolamine | 4.0 | 6.7 | 3.6 |
| NaOH & KOH | 4.9 | — | 4.2 |
| Sodium toluene sulfonate | — | 5.0 | — |
| Sodium formate | 1.0 | 1.0 | 1.0 |
| Perfume, colorants, fabric whiteners and other miscellaneous optional ingredients | | Remainder | |
| pH | 8.4 | 8.4 | 8.0 |

Stain removal performance of Compositions A, B and C of Example II is comparable to that obtained with Treatment 2 of Example I.

EXAMPLE III

The following compositions are prepared by spray drying a water slurry of the components to provide a granular detergent composition.

| | A | B | C |
|---|---|---|---|
| Sodium $C_{12}$ alkylbenzenesulfonate | 8% | 8% | 20% |
| Sodium tallow alkyl sulfate | 8 | 8 | — |
| Sodium Carbonate | 15 | 18 | 25 |
| Sodium Aluminosilicate (Zeolite A) | — | 25 | — |
| Sodium Silicate | 10 | 1 | 15 |
| Sodium Polyacrylate | — | 3 | 5 |
| Sodium HEDTA | 2 | 5 | 3 |
| Sodium Nitrilotriacetate | 15 | — | — |
| Sodium Sulfate, Water and Miscellaneous | Remainder | Remainder | Remainder |

Stain removal performance of the compositions of Example III are substantially superior to the same compositions without sodium HEDTA.

What is claimed is:

1. An aqueous liquid laundry detergent composition essentially free of inorganic phosphate salts comprising:

(a) from about 10% to about 65% by weight of a detergent surfactant selected from the group consisting of non-soap anionic surfactants, nonionic surfactants, zwitterionic surfactants, ampholytic surfactants, cationic surfactants and mixtures thereof;

(b) from about 8% to about 18% by weight of a detergency builder selected from the group consisting of $C_{10-18}$ monocarboxylic acids, alkali metal, ammonium or substituted ammonium salts thereof, and mixtures thereof; and (c) from about 0.5% to about 10% by weight hydroxyethylethylenediaminetriacetic acid, or alkali metal, alkaline earth, ammonium or substituted ammonium salts thereof or mixtures thereof, said composition being essentially free of inorganic detergency builders and providing a solution pH of from about 6 to about 8.5 at a 1% concentration in water.

2. The composition of claim 1 wherein the surfactant comprises anionic surfactants selected from the group consisting of alkylbenzene sulfonates, alkyl sulfates, alkyl ethoxy ether sulfates and mixtures thereof.

3. The composition of claim 1 comprising from about 2.5% to about 8% hydroxyethylethylenediaminetriacetic acid or salts thereof.

4. The composition of claim 2 which additionally comprises a nonionic surfactant selected from $C_{12-20}$ alcohols ethoxylated with an average of from about 6 to about 10 moles of ethylene oxide per mole of alcohol.

5. The composition of claim 1 additionally comprising from about 0.2% to about 10% by weight of citric acid or a salt thereof.

6. A granular laundry detergent composition essentially free of inorganic phosphate salts comprising:

(a) from about 10% to about 65% by weight of a detergent surfactant selected from the group consisting on non-soap anionic surfactants, nonionic surfactants, zwitterionic surfactants, ampholytic surfactants, cationic surfactants and mixtures thereof;

(b) from about 3% to about 60% by weight of a detergency builder selected from the group consisting of water-insoluble sodium aluminosilicates and organic detergency builders selected from the group consisting of $C_{10-18}$ monocarboxylic acids, polycarboxylic acids not containing both nitrogen and hydroxyalkyl radicals, polymeric carboxylates, polyphosphonic acids, alkali metal, ammonium or substituted ammonium salts thereof, and mixtures thereof;

(c) from about 0.5% to about 10% by weight hydroxyethylethylenediaminetriacetic acid, or alkali metal, alkaline earth, ammonium or substituted ammonium salts thereof or mixtures thereof;

(d) from 0% to about 75% by weight of a water-soluble inorganic detergency builder selected from the group consisting of alkali metal silicates, alkali metal carbonates and mixtures thereof.

7. The composition of claim 6 comprising at least about 3% by weight of said organic detergency builders.

8. The composition of claim 6 wherein said composition is a granular detergent composition comprising at least about 40% by weight of an inorganic detergency builder selected from the group consisting of alkali metal silicates, alkali metal carbonates and mixtures thereof.

9. The composition of claim 6 wherein the surfactant of component (a) comprises anionic surfactants selected from the group consisting of alkylbenzene sulfonates, alkyl sulfates, alkyl ethoxy ether sulfates and mixtures thereof.

10. The composition of claim 6 wherein component (c) comprises from about 2.5% to about 8% hydroxyethylethylenediaminetriacetic acid or salts thereof.

* * * * *